United States Patent [19]

Nelepka

[11] Patent Number: 4,928,686

[45] Date of Patent: May 29, 1990

[54] LIGHTWEIGHT BREATHING DEVICE

[76] Inventor: Guy S. Nelepka, 2327 N. Tustin Ave., Newport Beach, Calif. 92660

[21] Appl. No.: 293,071

[22] Filed: Jan. 3, 1989

[51] Int. Cl.[5] ..... A62B 9/02

[52] U.S. Cl. ..... 128/205.24; 128/204.26

[58] Field of Search ..... 128/205.22, 204.26, 128/205.24, 204.18

[56] References Cited

U.S. PATENT DOCUMENTS

| | | | |
|---|---|---|---|
| 4,062,356 | 12/1977 | Merrifield | 128/205.22 |
| 4,297,998 | 11/1981 | Chritianson | 128/204.26 |
| 4,798,203 | 1/1989 | Bartos | 128/205.22 |

*Primary Examiner*—Edgar S. Burr
*Assistant Examiner*—Aaron J. Lewis
*Attorney, Agent, or Firm*—Willie Krawitz

[57] ABSTRACT

A lightweight breathing device for underwater use, and in contaminated air is disclosed. The device employs a one-way valve which requires only one hand to effect operation, and a closure stem which is securely mounted against excessive air pressure from the valve, when air is released therethrough from an attached air tank. The one-way valve includes two interfitting components, one of which is rotatable, and which provides air orifices that form an air connection upon rotation to permit the release of air from the air tank.

8 Claims, 1 Drawing Sheet

LIGHTWEIGHT BREATHING DEVICE

BACKGROUND OF THE INVENTION

This invention relates to a new and improved portable breathing device which may be employed for underwater purposes, and for use above water in contaminated air situations, and where emergency alternative air supply sources are required.

Typically, the portable breathing device of this invention is used in conjunction with a lightweight air supply for relatively short periods of time, say 2–5 minutes. The device of this invention is lightweight, and of a sturdy construction, which enables it to be easily manipulated. The lightweight feature of this device permits the user a greater degree of mobility in escaping to a safe location without being encumbered by heavy air tanks or cumbersome or awkward air supply.

Some prior art breathing devices have used poppet valve components which pose a hazard to the user in that they can be ejected from the device with considerable force and injure the user, or persons nearby.

Other prior art devices use a burst disc which may pose a hazard to the user due to inadequate design.

THE INVENTION

According to the invention, there is provided a breathing device with a unique on-off air release mechanism to an air supply tank which may be operated with one hand, and a simple and safe air release closure mechanism which enables the user to release air at controlled intervals for breathing purposes.

The one-off air release mechanism includes interfitting components, one of which is rotatable, and each of these components provides air connecting orifices which permit air to be released from the air supply tank to the air release closure mechanism. Both the on-off air release mechanism and the air release closure can be operated with the same hand.

Figure 1A:
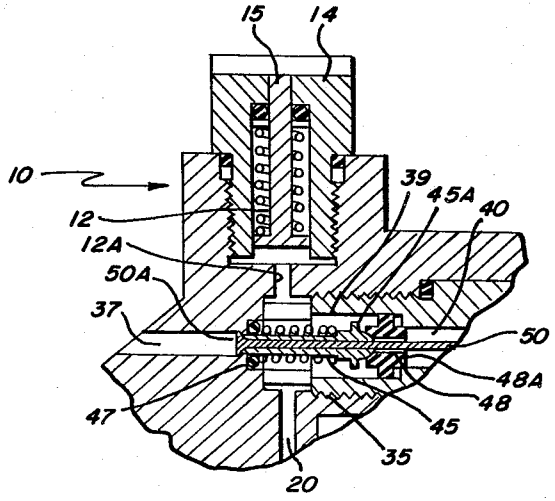
FIG. 1A is an enlarged view of a portion of FIG. 1.
Figure 1:
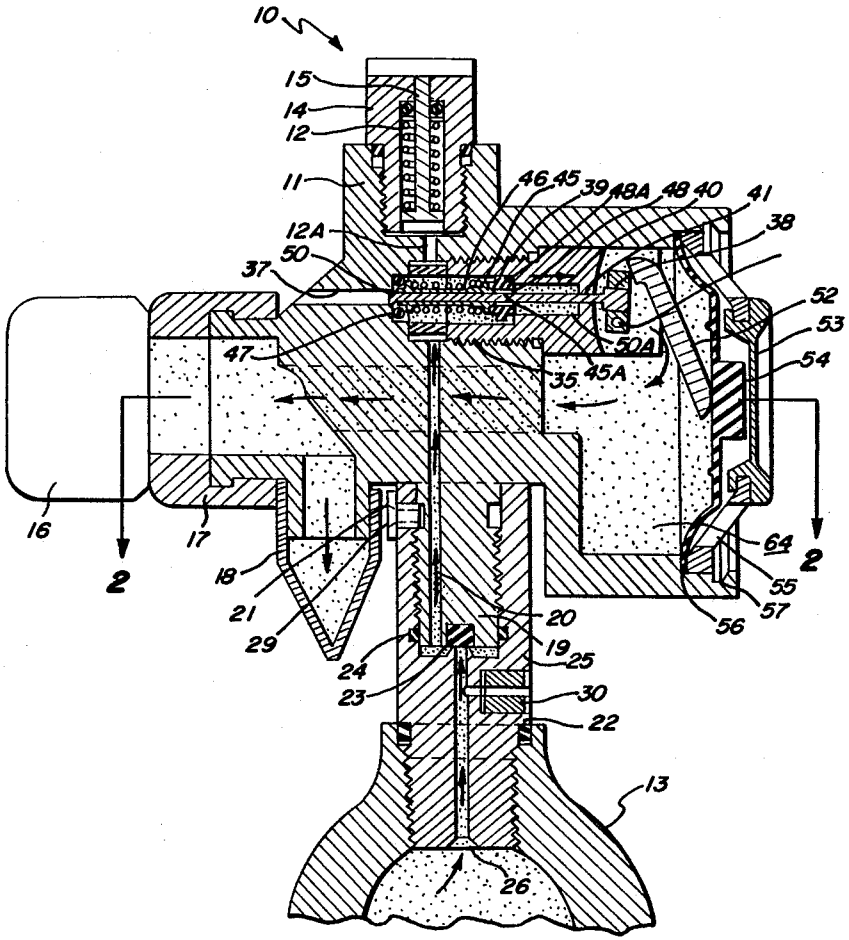
FIG. 1 is a cross sectional view in side elevation of the device of this invention.

DESCRIPTION OF THE PREFERRED EMBODIMENTS:

The breathing device 10 of this invention is shown in FIG. 1, and comprises a body portion 11, fill port 12 and an air tank 13 which is filled with air through the fill port 12 and bore 12*a*, using a refill adaptor attached to a refill supply tank (not shown). After the air tank 13 has been filled, the breathing device 10 is shut off, and the adaptor and supply tank are removed, and a seal plug 14 bearing a spring loaded pressure gauge stem 15 are mounted in the port 12 to seal the device. When the air tank is loaded, it weighs about 2–3 pounds, and has a reserve capacity of about 2–5 minutes based on continuous or intermediate breathing.

A breathing mouthpiece 16 is attached to the forward end of the device 10 through a connector 17, and an exhaust element 18 is employed to pass exhaust air from the user. An on-off housing insert valve 19 is formed as an integral part of the body portion 11 and defines an off-center, longitudinal bore 20, and a 270° stop screw bore 21. The on-off housing insert valve 19, together with a valve seat 23, and a valve O-ring 24 fit into a rotatable steel cylinder stem 25, the latter defining a stop screw bore 21 and a burst disc port 22. A longitudinal bore 26 is defined by the cylinder stem 25 to form an air connection with bore 20 when cylinder stem 25 rotates through a 270° turn. When valve 19 turns on it admits air from the air tank 13 into the breathing device. The rotatable cylinder stem 25 may be conveniently operated with one hand only, thereby enabling the air supply from the air tank to be easily turned on or off.

A stop screw 29 is threaded into the stop screw bore 21 to prevent turning cylinder stem 25 past the air connection region of the longitudinal bores 20 and 26. Hence, it is not necessary for the user to make any special effort or adjustment procedures to effect opening or closing of the on-off valve, since the air connection between bores 20, 26 will occur as the stop screw 29 is rotated between 70° and the full 270°.

A burst disc 30 is fitted into the burst disc port 22 of the cylinder stem 25 to guard against over pressurisation of the breathing device, and is strategically positioned to prevent any internal or external damage to the breathing device if overpressurisation occurs. Thus, if the user is holding the body portion 11 of the device, the burst disc 30 is positioned away from the user. Hence, rupture of the burst disc will occur away from the user, and will not be directed into the device.

An air regulator housing 38, having an air regulator bore 35, is air connected to the bores 20 and 26 of the housing insert valve 19 and cylinder stem 25 through a body portion 36 positioned along lines 2—2 of FIG. 1. The body portion 36 is shown in greater detail in FIG. 2, and will be described, infra. Air pressure is balanced to ambient through an atmospheric air bore 37 which is connected to a poppet bore cavity 39 of an air regulator housing 38.

The regulator housing 38 is threadably mounted in the body portion 11, and defines a central cavity 39, a poppet stem cavity 40, and a poppet stem bore 41. A poppet 45, having a head end 45*a*, is secured within the poppet bore cavity 39 of the regulator housing 38 by a spring 46 and sealed at the entrance to the air pressure equalization bore 37 by an O-ring 37. The head end 45*a* of the poppet seats and seals off a regulator housing seat 48 in conjunction with an O-ring 48*a*.

A poppet stem 50 having an integrally formed shoulder 50*a* is mounted or molded within the poppet 45 and is firmly attached thereto by means of a roughened exterior surface. Alternatively, the poppet stem 50 may employ only a roughened surface and attach within the poppet 45 without a shoulder construction. Another possible construction may employ the formed shoulder 50*a* mounted into a cavity bore in head end 45*a*. The poppet stem 50 passes through the poppet stem cavity 40 and poppet stem bore 41, and is secured by a pivot lever 51. A purge lever 52 is employed to actuate the pivot lever 51, and drive the poppet stem 50, and the poppet 45 from the regulator housing seat 48, to allow air flow and purging. An adjustment screw (not shown) is adapted to preset the tension of the spring 46 so that water pressure at atmospheric applied through the air equalization bore 37 will be sufficient to maintain the poppet closed.

The construction of the poppet stem 50 with a roughened surface and/or shoulder 50*a* provides a safe arrangement in that it is highly unlikely for the poppet stem to become dislodged from the poppet 45 and be driven out of the device. This will prevent injury to a user or persons nearby.

Figure 2:
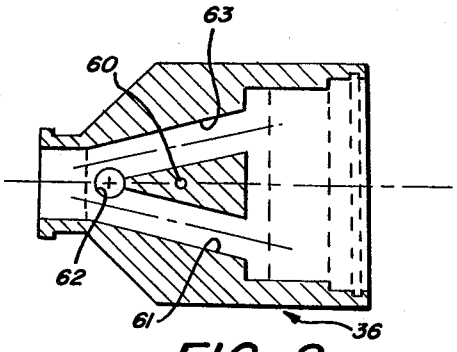
FIG. 2 is a plan view of the device, taken along lines 2—2 of FIG. 1.

Finger or suction pressure applied to the purge lever 52 will be applied to the poppet stem 50 by means of an assembly comprising a purge button 53 acting upon a diaphragm 54, the latter being reinforced by a diaphragm disc 58. The purge button 53 is surrounded by a cover 55, and the assembly is secured within a circular shoulder 56 along with a diaphragm retainer 57. When the purge button 53 is pressed, water and moisture will be expelled from the device through an exhaust bore 62 of body portion 36, and out exhaust element 18, as shown in FIGS. 1 and 2. A bore 60 of body portion 36 forms an air connection with the longitudinal bore 20 of the on-off housing insert valve 19, and will admit air from the air tank 13 to the device when the cylinder stem 25 is rotated so that bore 26 makes the air connection with bore 20. When the purge button is pressed, the poppet 45 will be unseated from the regulator housing seat 48. This will release or blow out water and moisture along manifolds 61 and 63 of the body portion 36 and through the exhaust port bore 62, and to the exhaust element 18, as shown in FIGS. 1 and 2.

When the user draws on the mouthpiece 16, sufficient suction causes the poppet 45 to unseat and admit air to an inner chamber along manifold channels 61 and 63 of the body 36 to the mouthpiece, and hence the user. When the user exhales, the poppet will close and exhaust air will pass through the bore 62 and out exhaust element 18.

The device of this invention is simple to operate, and the components of the breathing device do not present a problem of exploding parts. Use of the device of this invention when underwater can become critically important as a back-up device if a major air system fails, because it is portable and totally independent of the major air supply system, and it enables the user adequate time and leeway to escape due to failure of a life support system. It will also be appreciated that in a smoke or contaminated air environment, the lightweight nature and ease of use enables a user to avoid reliance on a much heavier air supply system. The same situation would prevail if there were not available air supply system or if a permanently attached air supply system were to malfunction or fail.

I claim:

1. An air breathing device, comprising a. a main body including a fill port for supplying air to an air supply tank mounted on the breathing device;

b. a rotatable cylinder stem defining a first orifice bore, the cylinder stem being mounted on the breathing device and attached to the air supply tank, the first orifice bore being connected to the air supply tank;

c. an on-off valve mounted on the cylinder stem and defining a second orifice bore, the first and second orifice bores being adapted to form an air connection upon sufficient rotation of the cylinder stem, thereby turning on and admitting air from the air supply tank to the device;

d. an air regulator housing mounted within the main body and connecting from the second orifice bore to a poppet bore cavity;

e. an elongate, spring loaded poppet means defining a longitudinal, axial bore, one end of the poppet means seating into an atmospheric bore, and an opposed end of the poppet means, including a poppet head, seating into and sealing the poppet bore cavity, and a poppet stem mounted and secured within the longitudinal, axial bore of the poppet;

f. a body portion mounted in the on-off valve and providing an air connection between the valve and the poppet means of the air regulator housing;

g. a breathing mouthpiece and exhaust port mounted on the air breathing device, the breathing mouthpiece being air connected through the body portion to the air regulator, housing and the poppet bore cavity, and the exhaust port being air connected to the body portion; and, h. a lever adapted to actuate the stem of the poppet means the poppet stem being connected to the lever through a poppet stem cavity contiguous with the poppet bore cavity and secured in the poppet stem cavity by a shoulder formed on the poppet stem; whereby: i. when the on-off valve is turned on, and a user inhales on the mouthpiece, sufficient suction is produced to unseat the poppet from the poppet bore cavity and admit air to the user from the air supply tank and through the connected first orifice bore, and then through the body portion; ii. when the user exhales on the mouthpiece, the poppet closes and exhaust air passes through the body portion to the exhaust port; and, iii. when the lever is pressed, the poppet will be unseated and release or blow out water and moisture through the body portion and exhaust port.

2. The air breathing device of claim 1, including an air cylinder attached to the cylinder stem for supplying air therethrough.

3. The air breathing device of claim 1, including a burst disc, positioned away from the said mouthpiece.

4. The air breathing device of claim 1, including stop screw means to enable air connection between the first and second bores of the cylinder stem and on-off valve, respectively, to be made over a wide area of rotation of the cylinder stem.

5. The air breathing device of Claim 1, in which the poppet stem, at an end remote from the poppet head, is positioned for movement with an atmospheric air bore, and water or air at atmospheric will maintain the poppet closed.

6. The air breathing device of claim 1, in which the cylinder stem is rotatable with one hand by the user.

7. The air breathing device of claim 1, in which the poppet stem provides a roughened surface to firmly attach the poppet stem to the poppet.

8. The air breathing device of claim 5, in which the poppet stem provides a roughened surface to firmly attach the poppet stem to the poppet.

* * * * *